US009523178B2

(12) United States Patent
Ferraiolo

(10) Patent No.: US 9,523,178 B2
(45) Date of Patent: Dec. 20, 2016

(54) ANCHORING SYSTEM FOR CONCRETE PANELS IN A STABILIZED EARTH STRUCTURE

(71) Applicant: Francesco Ferraiolo, Ca' de' Fabbri (IT)

(72) Inventor: Francesco Ferraiolo, Ca' de' Fabbri (IT)

(73) Assignee: OFFICINE MACCAFERRI S.P.A., Zola Predosa (Bologna) (IT)

( * ) Notice: Subject to any disclaimer, the term of this patent is extended or adjusted under 35 U.S.C. 154(b) by 0 days.

(21) Appl. No.: 15/052,407

(22) Filed: Feb. 24, 2016

(65) Prior Publication Data

US 2016/0168814 A1 Jun. 16, 2016

Related U.S. Application Data

(63) Continuation of application No. 14/809,884, filed on Jul. 27, 2015, now abandoned, which is a continuation of application No. 13/902,305, filed on May 24, 2013, now abandoned.

(51) Int. Cl.

| | |
|---|---|
| ***E02D 5/76*** | (2006.01) |
| ***E02D 29/02*** | (2006.01) |
| ***E02D 29/16*** | (2006.01) |
| ***E02D 5/80*** | (2006.01) |

(52) U.S. Cl.

CPC . *E02D 5/76* (2013.01); *E02D 5/80* (2013.01); *E02D 29/02* (2013.01); *E02D 29/0225* (2013.01); *E02D 29/0233* (2013.01)

(58) Field of Classification Search

CPC .. E02D 29/0233; E02D 29/0241; E02D 17/20; E02D 29/05; E02D 29/0225; E02D 17/202; E02D 5/76; E02D 5/80; E04C 5/12; E04C 5/17; B66B 1/666

USPC ..... 52/4, 125.2–125.5, 223.13, 379, 513, 52/148; 54/87; 294/215; 403/210, 213; 405/262, 284, 286

See application file for complete search history.

(56) References Cited

U.S. PATENT DOCUMENTS

| | | | |
|---|---|---|---|
| 1,836,744 | A | 12/1931 | Bankwitz |
| 2,049,352 | A | 7/1936 | Camp |
| 2,364,328 | A | 12/1944 | Garlinghouse |
| 3,650,112 | A | 3/1972 | Howlett et al. |
| 3,867,046 | A | 2/1975 | Fox |
| 4,267,615 | A | 5/1981 | Nealy |
| 4,273,476 | A | 6/1981 | Kotulla et al. |
| 4,343,571 | A | 8/1982 | Price |
| 4,514,113 | A | 4/1985 | Neumann |
| 4,929,125 | A | 5/1990 | Hilfiker |
| 5,469,675 | A | 11/1995 | Arteon |
| 5,730,556 | A | 3/1998 | Barley |
| 5,768,847 | A | 6/1998 | Policelli |
| 5,839,855 | A | 11/1998 | Anderson et al. |
| 6,120,074 | A | 9/2000 | Hamrick |
| 6,209,279 | B1 | 4/2001 | Meier et al. |
| 6,343,449 | B1 | 2/2002 | MacKarvich |
| 7,086,803 | B2 | 8/2006 | Ackerman et al. |

(Continued)

FOREIGN PATENT DOCUMENTS

JP 58065819 A 4/1983

*Primary Examiner* — Robert Canfield

(74) *Attorney, Agent, or Firm* — Flynn, Thiel, Boutell & Tanis, P.C.

(57) ABSTRACT

The concrete panel anchoring assembly including a concrete panel having a rear face and a connector member projecting from a rear face of the concrete panel. The connector member includes an attachment loop and a saddle element assembled together.

18 Claims, 4 Drawing Sheets

(56) References Cited

U.S. PATENT DOCUMENTS

| | | | |
|---|---|---|---|
| 7,125,202 | B2 | 10/2006 | Morizot et al. |
| 7,992,262 | B2 | 8/2011 | Thompson |
| 8,152,417 | B2 | 4/2012 | Freitag et al. |
| 9,103,089 | B2 | 8/2015 | Ogorchock |
| 2001/0014255 | A1 | 8/2001 | Orsat |
| 2006/0051166 | A1 | 3/2006 | Lee |
| 2006/0193699 | A1 | 8/2006 | Freitag et al. |
| 2007/0003381 | A1 | 1/2007 | Lee |
| 2007/0009331 | A1 | 1/2007 | Lee |
| 2009/0285640 | A1 | 11/2009 | Hilfiker et al. |
| 2012/0063852 | A1 | 3/2012 | Ruel |
| 2012/0076592 | A1 | 3/2012 | Freitag et al. |
| 2013/0022411 | A1 | 1/2013 | Cariou |
| 2013/0136544 | A1 | 5/2013 | McKittrick |
| 2013/0202367 | A1 | 8/2013 | Freitag et al. |
| 2013/0326967 | A1 | 12/2013 | Kim |
| 2014/0270991 | A1 | 9/2014 | Ogorchock et al. |

ANCHORING SYSTEM FOR CONCRETE PANELS IN A STABILIZED EARTH STRUCTURE

CROSS-REFERENCE TO RELATED APPLICATIONS

This is a continuation of prior U.S. application Ser. No. 14/809,884, filed Jul. 27, 2015, which is a continuation of U.S. application Ser. No. 13/902,305, filed May 24, 2013, now abandoned.

FIELD OF THE INVENTION

The present invention relates to an anchoring system and anchoring devices to anchor concrete panels in a stabilized earth structure.

BACKGROUND OF THE INVENTION

In one type of known stabilized earth structure, the earth is stabilized by a plurality of elongate stabilizing elements extending rearwardly from a facing into an earth mass.

In such stabilized earth structures, the earth is stabilized throughout the mass by frictional engagement with the stabilizing elements which may be in the form of strips. Commonly, the facing of the stabilized earth structure consists of concrete panels which are anchored to the forward ends of the strips.

Known anchoring systems comprise protrusions in the form of hooks or the like which are attached to the rear part of the concrete panels and to which the strips are tied or wrapped around. Some known systems provide for the protrusion to be cast directly into the panels during the prefabrication stage. A known type of protrusion is made of a bent steel wire having an omega-like shape.

Known anchoring systems can be difficult to put in place during the prefabrication of the concrete panels. Moreover, when made of steel wire, they are subject to oxidation, especially because of the humidity of the earth that contacts the anchoring systems when the stabilized earth structure is in place.

SUMMARY OF THE INVENTION

It is an aim of the present invention to provide an anchoring system and anchoring devices to anchor concrete panels in a stabilized earth structure with improved characteristics, performance, ease of use and simplicity with respect to the known art.

BRIEF DESCRIPTION OF THE DRAWINGS

Further characteristics and advantages will become more evident from the following detailed description of a preferred embodiment, given by way of non-limiting example, for the purpose of explaining the principles of the present invention, with reference to the attached drawings, wherein.

DETAILED DESCRIPTION

Figure 1:
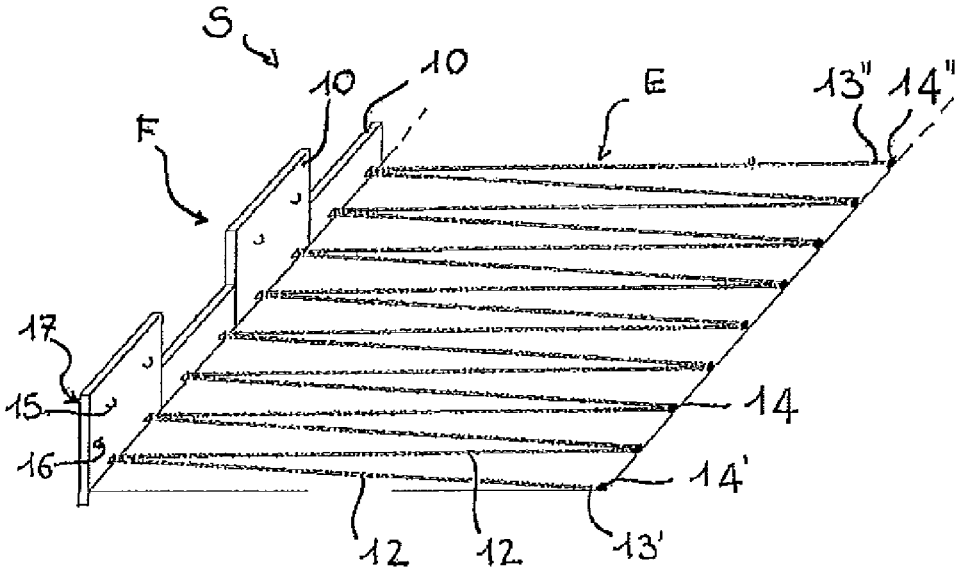
FIG. 1 schematically shows a construction site where an anchoring system according to the present invention is employed to anchor concrete panels in a stabilized earth structure.

FIG. 1 schematically shows a construction site S where an anchoring system according to the present invention is employed to anchor concrete panels 10 in a stabilized earth structure E. Concrete panels 10 are aligned adjacent to each other and subsequently superimposed to each other to form a facing F of the stabilized earth structure. Shape, design and specific placement of the concrete panels 10 with respect to each other can vary according to the specific choice of panels to be used. The choice of panel shape and layout is known in the art and is outside the scope of the present invention.

The earth is stabilized by a plurality of elongate stabilizing elements 12 extending rearwardly from the facing F of the structure into an earth mass. In the example of FIG. 1, all or many of the stabilizing elements 12 are formed by a single web element with a first end 13' fixed to an initial nail or peg 14' and running in a zig-zag fashion alternatively to connector members 15 projecting rearwardly from each panel 10 and to subsequent nails or pegs 14, to reach a final nail or peg 14", where its other end 13" is fixed.

More in detail, each connector member 15 projects from a rear face 16 of the panels 10 opposite to a front face 17, which contributes to form part of the actual facing F of the stabilized earth structure E, that is, the side which remains most often visible upon completion of the work. FIG. 1 shows panels 10 where at each predetermined height in the configuration of alternately staggered panels 10, two connector members 15 are provided for each panel 10. The number and position of connector members 15 in the rear face 16 of each panel can naturally change with respect to what is illustrated, and can be adapted to each specific requirement depending on the project, the building site, the dimension and shape of the panels, their relative position (e.g., staggered, aligned, superimposed, etc.), and the like.

Figure 2:
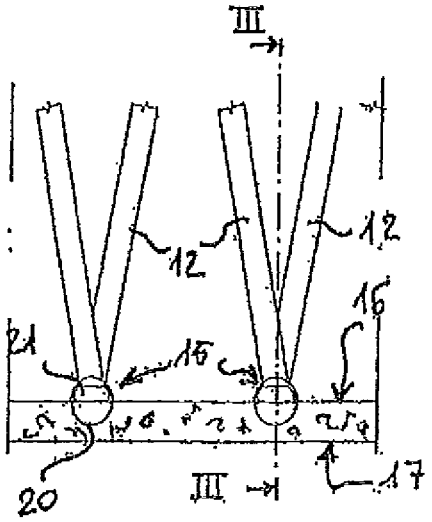
FIG. 2 schematically shows a transverse cross-section of an exemplary concrete panel bearing a couple of anchoring devices incorporated therein.
Figure 3:
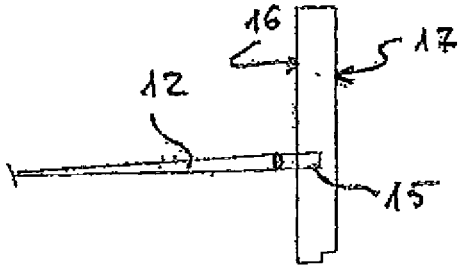
FIG. 3 is a cross-section along line III-III in FIG. 2.
Figure 4:
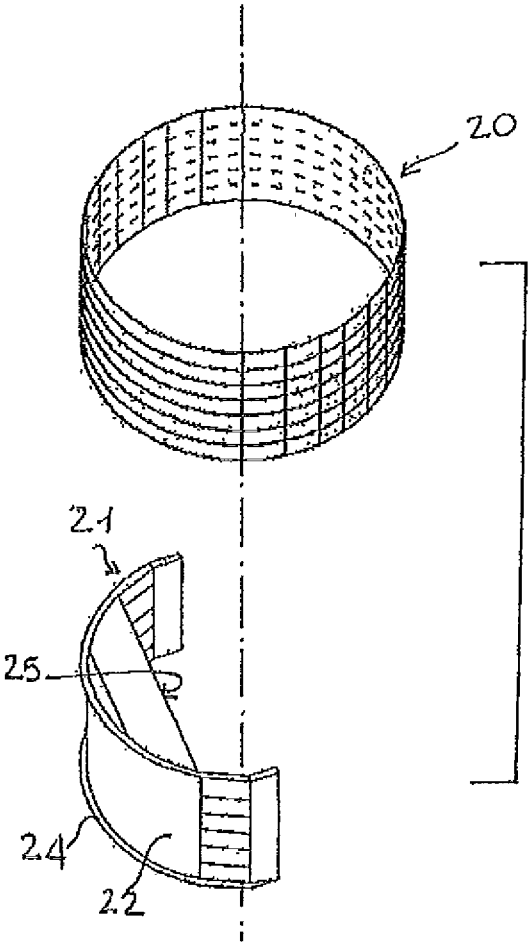
FIG. 4 is a schematic exploded view of an anchoring device which can be incorporated in a concrete panel.
Figure 5:
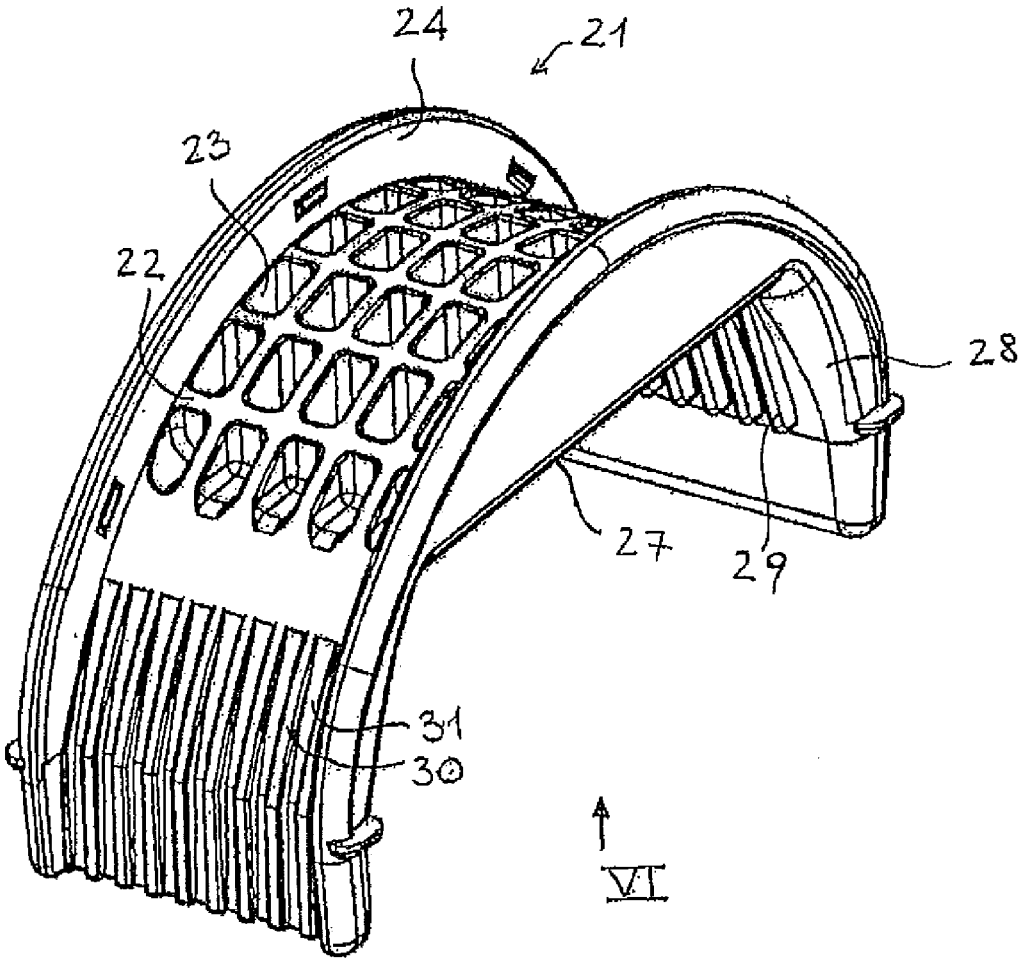
FIG. 5 is a prospective view of a saddle component of the anchoring device of FIG. 4.
Figure 6:
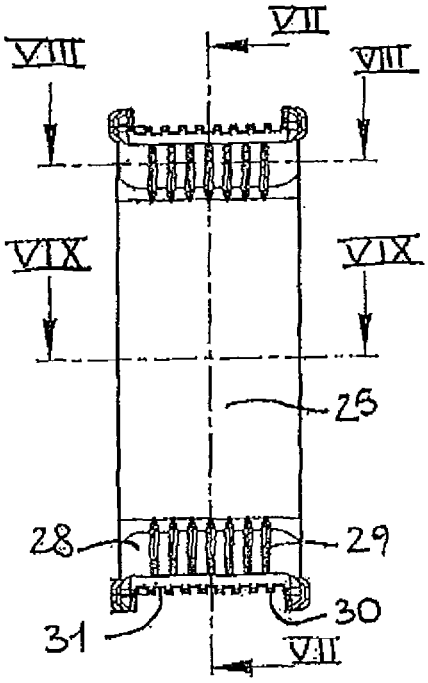
FIG. 6 is a view along arrow VI in FIG. 5.
Figure 7:
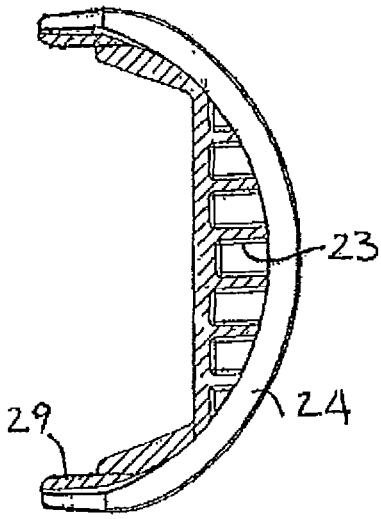
FIG. 7 is a cross-section along line VII-VII in FIG. 6.
Figure 8:
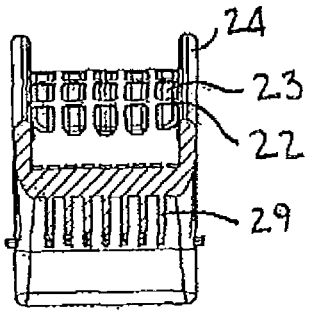
FIG. 8 is a cross-section along line VIII-VIII in FIG. 6.
Figure 9:
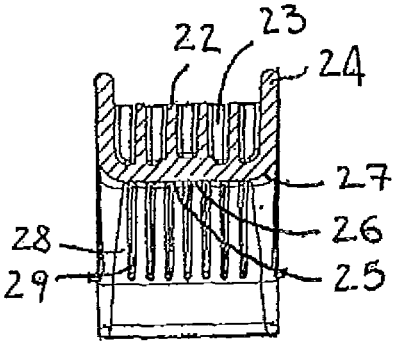
FIG. 9 is a cross-section along line VIX-VIX in FIG. 6.

As shown in better detail in FIGS. 2 to 4, each single connector member 15 is formed by an attachment loop 20 and a saddle element 21 assembled together. The attachment loop 20 is preferably made of a wide polymer strip, preferably but not limitatively of about 4 cm of width, rolled up a few times, preferably 3 or 4 times, forming a ring with a diameter which can be preferably between 10 and 20 cm and in the preferred although non-limiting example is of approximately 15 cm. The polymer strip is preferably made of discrete bundles of high strength synthetic fibers enclosed in a relatively tough and durable polymeric sheath and is heat sealed to form the ring.

The attachment loop 20 is mounted to the stiff saddle element 21 made of plastic (preferably polypropylene) which is better illustrated in FIGS. 5 to 9 in its preferred, although non limiting embodiment. The saddle element 21 comprises a substantially semi-circular or arc-shaped supporting wall 22 whose surface includes a number of cavities 23. Two lateral shoulders 24 are provided to retain the attachment loop 20 within the boundary of the arc-shaped supporting wall 22. A plurality of ridges 30 are provided on its edges 31 for reinforcement and better adhesion to the concrete.

On the concave part of the arc-shaped supporting wall 22 a reinforced thick wall 25 has a substantially flat portion 26 and rounded sides 27. Also on the concave part of the saddle element 21 a plurality of ridges 29 are provided at its edges 28.

In use, a connector member 15 is made by assembling an attachment loop 20 and a saddle element 21, by introducing the saddle element 21 inside the attachment loop 20 so that part of it rests on the arc-shaped supporting wall 22, between the two lateral shoulders 24. When concrete panels 10 are cast, using a concrete mixture poured in a die, the desired number of connector members 15 is partly immersed in the fluid concrete mixture, in the desired position on the back of the panels, to the extent that the edges 28 of the saddle element 21 are immersed in the concrete but sufficient clearance is left between the thick wall 25 and the concrete surface. This can be simply accomplished by a person holding the connector member 15 with a hand around the thick wall 25 and pushing the connector member 15 into the concrete mixture until knuckles of the hand are about to touch or are touching the concrete mixture. This provides for ease of manufacture of the panels 10 comprising the connector of the present invention.

The panels manufactured in this manner can then be used to build an earth reinforcing structure as described above, with a plurality of panels placed one next to the other and with stabilizing elements 12 extending into the earth and connected to the panels via the connector members 15.

The connection member of the present invention has an increased resistance, thanks to the saddle element 21 that distributes on the whole connector member 15 the force applied by the stabilizing elements 12.

Naturally, the principle of the invention remaining the same, the specific features and the embodiments of the invention can be varied without departing from what has been described and illustrated.

I claim:

1. A concrete panel anchoring assembly comprising:

a concrete panel having a rear face; and a connector member projecting from the rear face of the concrete panel, the connector member including an attachment loop and a saddle element, the attachment loop having a first part embedded in a non-movable and fixed manner within the concrete panel and a second part projecting outwardly from the rear face of the concrete panel, the saddle element supportingly engaging the second part of the attachment loop exteriorly of the concrete panel;

wherein the saddle element comprises a substantially arc-shaped supporting wall on which the second part of the attachment loop is supported, a substantial portion of the substantially arc-shaped supporting wall being disposed exteriorly of the concrete panel; and wherein the saddle element has a pair of terminal ends disposed adjacent opposite ends of the substantially arc-shaped supporting wall and portions of the terminal ends are embedded in a fixed manner within the concrete panel with the substantially arc-shaped supporting wall of the saddle element projecting outwardly from the rear face of the concrete panel.

2. The concrete panel anchoring assembly according to claim 1, wherein the attachment loop is made of a rolled up polymer strip.

3. The concrete panel anchoring assembly according to claim 2, wherein the polymer strip is made of discrete bundles of synthetic fibers enclosed in a polymeric sheath.

4. The concrete panel anchoring assembly according to claim 2, wherein the saddle element comprises two lateral shoulders which are sidewardly spaced from one another, extend along the substantially arc-shaped supporting wall and define a boundary of the substantially arc-shaped supporting wall, the attachment loop being supported on the substantially arc-shaped supporting wall between the two lateral shoulders and being retained on the substantially arc-shaped supporting wall by the two lateral shoulders.

5. The concrete panel anchoring assembly according to claim 1, wherein the substantially arc-shaped supporting wall includes a number of cavities therein.

6. The concrete panel anchoring assembly according to claim 1, wherein a plurality of ridges are provided on the respective terminal ends of the saddle element.

7. The concrete panel anchoring assembly according to claim 1, wherein the saddle element comprises two lateral shoulders sidewardly spaced from one another on opposite sides of the substantially arc-shaped supporting wall and defining a lateral boundary of the substantially arc-shaped supporting wall, the second part of the attachment loop being supported on the substantially arc-shaped supporting wall between the two lateral shoulders, the two lateral shoulders laterally retaining the second part of the attachment loop on the substantially arc-shaped supporting wall.

8. The concrete panel anchoring assembly according to claim 7, wherein the substantially arc-shaped supporting wall includes a number of cavities therein.

9. The concrete panel anchoring assembly according to claim 8, wherein the saddle element is made of polypropylene.

10. The concrete panel anchoring assembly according to claim 8, wherein the saddle element is made of plastic.

11. The concrete panel anchoring assembly according to claim 10, wherein the saddle element is made of polypropylene.

12. The anchoring concrete panel anchoring assembly according to claim 1, wherein the attachment loop comprises a rolled strip of material.

13. The concrete panel anchoring assembly according to claim 12, wherein the attachment loop is a rolled up polymer strip.

14. The connector concrete panel anchoring assembly according to claim 13, wherein the polymer strip is rolled up at least four times.

15. The concrete panel anchoring assembly according to claim 14, wherein the polymer strip is made of discrete bundles of synthetic fibers enclosed in a polymeric sheath.

16. The concrete panel anchoring assembly according to claim 1, wherein the attachment loop comprises a closed ring.

17. The concrete panel anchoring assembly according to claim 1, wherein a substantial portion of the attachment loop extends along and is supported by an exterior surface of the saddle element.

18. The concrete panel anchoring system according to claim 1, wherein the attachment loop comprises a closed and continuous rolled strip of material.

* * * * *